US011969029B2

(12) United States Patent
Liu

(10) Patent No.: US 11,969,029 B2
(45) Date of Patent: Apr. 30, 2024

(54) BRASSIERE AND METHOD OF MANUFACTURING THE BRASSIERE

(71) Applicant: Regina Miracle International (Group) Limited, Hong Kong (CN)

(72) Inventor: Zhenqiang Liu, Hong Kong (CN)

(73) Assignee: Regina Miracle International (Group) Limited, Hong Kong (CN)

( * ) Notice: Subject to any disclaimer, the term of this patent is extended or adjusted under 35 U.S.C. 154(b) by 217 days.

(21) Appl. No.: 17/631,113

(22) PCT Filed: Jul. 29, 2019

(86) PCT No.: PCT/CN2019/098155
§ 371 (c)(1),
(2) Date: Jan. 28, 2022

(87) PCT Pub. No.: WO2021/016792
PCT Pub. Date: Feb. 4, 2021

(65) Prior Publication Data
US 2022/0211120 A1 Jul. 7, 2022

(51) Int. Cl.
*A41C 3/12* (2006.01)

(52) U.S. Cl.
CPC ..... *A41C 3/12* (2013.01)

(58) Field of Classification Search
CPC ..... A41C 3/12; A41C 1/14
USPC ..... 450/80
See application file for complete search history.

(56) References Cited

U.S. PATENT DOCUMENTS 2,940,453 A * 6/1960 Lerner ..... A41D 7/001 450/55
3,704,713 A * 12/1972 Hopper ..... A41C 3/0007 450/52
4,203,449 A * 5/1980 Winzelberg ..... A41C 3/0007 450/49
5,215,494 A * 6/1993 Flanagan ..... A41C 3/0007 2/73
6,190,232 B1 * 2/2001 Boser ..... A41C 3/0007 450/47

(Continued)

FOREIGN PATENT DOCUMENTS

CN 200976838 Y 11/2007
CN 201709474 U 1/2011

(Continued)

OTHER PUBLICATIONS

Authorized Officer: Wang,Xiaoli, International Search Report and Written Opinion issued in PCT application No. PCT/CN2019/098155, May 6, 2020, 9 pp.

*Primary Examiner* — Timothy K Trieu
(74) *Attorney, Agent, or Firm* — Kaplan Breyer Schwarz, LLP

(57) ABSTRACT

A brassiere having a side-wing and a bra cup is disclosed. The bra cup has a cup portion and a flange portion attached to the side-wing. The flange portion includes a flange disposed at an inner side of the bra cup, and an outer layer being disposed at an outer side of the bra cup and coupled to the flange. Further, a portion of the side-wing is disposed between the outer layer and the flange, and is attached to the outer layer by using at least one thread line. The at least one thread line is disposed on the outer side of the bra cup. Further, the inner side of the bra cup is devoid of thread line.

16 Claims, 9 Drawing Sheets

(56) References Cited

U.S. PATENT DOCUMENTS

| | | | | |
|---|---|---|---|---|
| 2007/0054597 | A1* | 3/2007 | Mone | A41C 3/00 450/54 |
| 2009/0311943 | A1* | 12/2009 | Mone | A41C 3/10 450/38 |

FOREIGN PATENT DOCUMENTS

| | | | |
|---|---|---|---|
| CN | 109480361 | A | 3/2019 |
| JP | H07133503 | A | 5/1995 |
| JP | H11350208 | A | 12/1999 |

* cited by examiner

BRASSIERE AND METHOD OF MANUFACTURING THE BRASSIERE

FIELD OF THE PRESENT DISCLOSURE

The present disclosure relates generally to a brassiere, and in particular, to a brassier including a bra cup having an outer side having at least one thread line, and an inner side devoid of thread line, and a method of manufacturing the brassiere.

BACKGROUND

A brassiere is worn by a wearer to be held firmly in place against her body and support the breasts in their proper position without exerting excessive pressure against them. The brassiere generally comprises a pair of bra cups and side wings attached to the bra cups and extending laterally outwardly from the bra cups. Typically, side wings are attached to the bra cups by sewing with threads. In such cases, threaded stitches are exposed both on the inner side and outer side of the brassiere. Exposed threaded stitches on the inner side of the brassiere are not comfortable, and hence not desirable.

SUMMARY

In an aspect, a brassiere is disclosed. The brassier includes a side-wing and a bra cup having a cup portion and a flange portion attached to the side-wing. The flange portion including a flange disposed at an inner side of the bra cup, and an outer layer being disposed at an outer side of the bra cup and coupled to the flange. The flange portion also includes a portion of the side-wing disposed between the outer layer and the flange. The portion of the side-wing is attached to the outer layer by using at least one thread line. The at least one thread line is disposed on the outer side of the bra cup, and the inner side of the bra cup is devoid of thread line.

In one or more embodiments, the at least one thread line includes a first thread line and a second thread line.

In one or more embodiments, the brassiere also includes a stabilizer sandwiched between the side-wing and one of the outer layer and the flange.

In one or more embodiments, the outer layer includes a second portion and a third portion. The second portion is formed by folding the outer layer. The second portion is disposed between the third portion of the outer layer and the side-wing.

In one or more embodiments, the flange includes a first portion and a second portion. The first portion is formed by folding the flange, and the first portion of the flange is sandwiched between the side-wing and the second portion of the flange. The at least one thread line runs through the first portion of the flange but not the second portion of the flange.

In one or more embodiments, the flange portion includes a wire channel disposed between the second portion of the outer layer and the third portion of the outer layer.

In one aspect, a method of manufacturing a brassiere is disclosed. The method includes providing a cup core having a cup and a flange extending along a periphery of the cup. The flange includes a first portion and a second portion separated by a fold line which is a virtual boundary line. The method further includes attaching a portion of a side-wing to the first portion of the flange, and attaching an outer layer to the first portion of the flange and the side-wing such that the side-wing is disposed between the flange and the outer layer. Also, the method includes attaching a wire channel to the outer layer and the flange, and folding the outer layer to enwrap the wire channel. Further, the method includes folding the outer layer and the first portion of the flange along the fold line to adhesively attach the first portion of the flange to the second portion of the flange. Furthermore, the method includes attaching a first portion of the outer layer to the cup. The portion of the side-wing is attached to the outer layer by using at least one thread line. The at least one thread line is disposed at an outer side of the bra cup and the inner side of the bra cup is devoid of thread line.

In one or more embodiments, the portion of the side-wing is attached to the first portion of the flange by using first threads.

In one or more embodiments, the method also includes positioning a stabilizer between the first portion of flange and the side-wing. The stabilizer is positioned abutting the inner surface of the flange.

In one or more embodiments, the outer layer includes a second portion and a third portion extending between the second portion of the outer layer and the first portion of the outer layer. The second portion of the outer layer is attached to the side-wing using second threads.

In one or more embodiments, the outer layer enwraps the wire channel such that the wire channel is sandwiched between the second portion of the outer layer and the third portion of the outer layer.

In one or more embodiments, the wire channel is attached to the outer layer and the flange by stitching the first portion of the flange, the side-wing, the second portion of the outer layer, and the wire channel by using third threads.

In one or more embodiments, the third portion of the outer layer, the second portion of the outer layer, the wire channel, and the first portion of the flange are stitched together using fourth threads.

In one or more embodiments, the method also includes inserting an underwire inside the wire channel.

In one or more embodiments, the cup core includes an outer fabric layer, an inner fabric layer, an inner foam layer disposed between the outer fabric layer and the inner fabric layer. The inner foam layer abuts the inner fabric layer. The cup core further includes an outer foam layer sandwiched between the outer fabric layer and the inner foam layer. The outer foam layer abuts the outer fabric layer and the inner foam layer. In one or more embodiments, the outer fabric layer, the outer foam layer, the inner foam layer, and the inner fabric layer are laminated together.

In another aspect, a brassiere is disclosed. The brassiere includes a side-wing and a bra cup having a cup portion and a flange portion attached to the side-wing. The flange portion includes a flange of a cup core, a portion of the side-wing, and an outer layer. The flange has a first portion and a second portion adhesively attached to the first portion. The second portion is disposed at an inner side of the bra cup. The portion of the side-wing is attached with the first portion of the flange. Further, the outer layer has a second portion and a third portion folded over the second portion, and enwrapping a wire channel therebetween. The third portion of the outer layer is disposed at an outer side of the bra cup. The second portion of the outer layer, the third portion of the outer layer, the wire channel, the first portion of the flange, and the side-wing are attached using at least one thread line. The at least one thread line is disposed on an outer side of the bra cup and the inner side of the bra cup is devoid of thread line.

In one or more embodiments, the brassiere also includes a stabilizer sandwiched between the first portion of the flange and the side-wing. The stabilizer abuts an inner surface of the flange and the side-wing.

In one or more embodiments, the brassiere also includes an underwire disposed inside the wire channel.

In one or more embodiments, the second portion of the outer layer is sandwiched between the wire channel and the side-wing. The second portion of the outer layer abuts the side-wing and the wire channel.

In one or more embodiments, the cup portion of the bra cup include a cup of the cup core and a first portion of the outer layer attached to the cup.

In one or more embodiments, the cup core includes an outer fabric layer, an inner fabric layer, and an inner foam layer disposed between the outer fabric layer and the inner fabric layer. The inner foam layer abuts the inner fabric layer. The cup core further includes an outer foam layer sandwiched between the outer fabric layer and the inner foam layer. The outer foam layer abuts the outer fabric layer and the inner foam layer. In one or more embodiments, the outer fabric layer, the outer foam layer, the inner foam layer, and the inner fabric layer are laminated together.

In one or more embodiments, the cup core further includes a foam pad sandwiched between the outer foam layer and the inner foam layer, and is located at an interface of the flange and the cup.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

For a more complete understanding of example embodiments of the present disclosure, reference is now made to the following descriptions taken in connection with the accompanying drawings in which.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details. In other instances, apparatuses and methods are shown in block diagram form only in order to avoid obscuring the present disclosure.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments. Further, the terms "a" and "an" herein do not denote a limitation of quantity, but rather denote the presence of at least one of the referenced item. Moreover, various features are described which may be exhibited by some embodiments and not by others. Similarly, various requirements are described which may be requirements for some embodiments but not for other embodiments.

The embodiments are described herein for illustrative purposes and are subject to many variations. It is understood that various omissions and substitutions of equivalents are contemplated as circumstances may suggest or render expedient, but are intended to cover the application or implementation without departing from the spirit or the scope of the present disclosure. Further, it is to be understood that the phraseology and terminology employed herein are for the purpose of the description and should not be regarded as limiting. Any heading utilized within this description is for convenience only and has no legal or limiting effect.

Where there is reference to the word "layer" it is to be understood that it may have its common definition and, but not limited to that the layer could consist of one panel or may have regions that are defined by two or more panels that are joined and that may each be of a different characteristic (e.g. color, thickness, material, orientation, size).

Figure 1A:
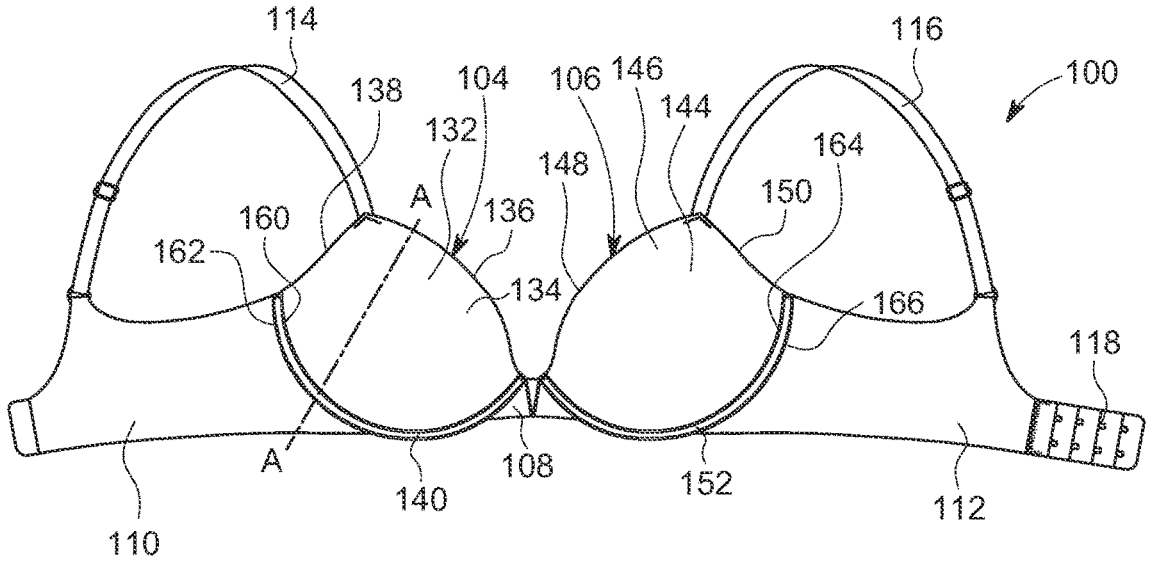
FIG. 1A illustrates a front view of a brassiere, in accordance with one or more embodiments of the present disclosure.
Figure 1B:
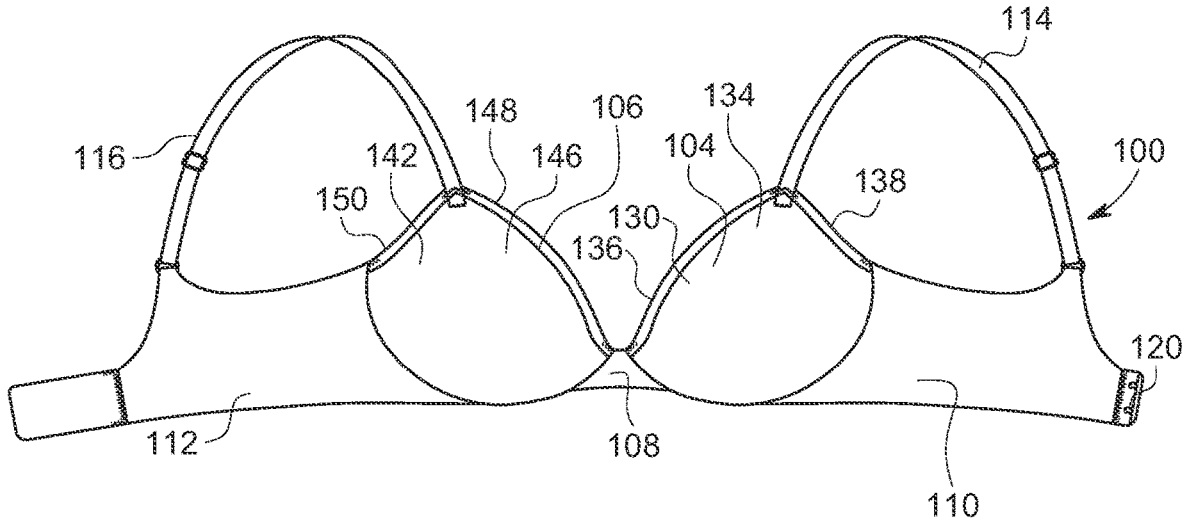
FIG. 1B illustrates a back view of the brassiere, in accordance with one or more embodiments of the present disclosure.

Referring to the FIGS. 1A and 1B, a brassiere 100 is shown according to an exemplary embodiment of the disclosure. The brassiere 100 includes a body structure 102 which defines a shape of the brassiere 100. The body structure 102 includes a pair of bra cups, for example, a first bra cup 104 and a second bra cup 106, and a center gore 108 disposed between the first bra cup 104 and the second bra cup 106 and connecting the first bra cup 104 and the second bra cup 106. Further, the brassiere 100 includes a pair of side-wings, including a first side-wing 110 and a second side-wing 112 are attached to lateral peripheries of the first bra cup 104 and the second bra cup 106, respectively. Also, a pair of straps, including a first strap 114 and a second strap 116 are attached to top peripheries of the first bra cup 104 and the second bra cup 106, respectively. In one or more examples, fasteners 118, 120 may be provided with the first side-wing 110 and the second side-wing 112. It may be contemplated that the pair of straps 114, 116 support the brassiere 100 on shoulders of the wearer, while the pair of side-wings 110, 112 support the brassiere 100 around a torso of the wearer, when worn. In some examples, the pair of straps 114, 116 and may be omitted, and only the pair of side-wings 110, 112 may support the brassiere 100 on the wearer.

Further, as shown in FIG. 1A and FIG. 1B, the first bra cup 104 includes an inner side 130, an outer side 132, a first cup portion 134 having a first neck line 136 and a first side edge 138, and a first flange portion 140 extending from the first cup portion 134. The outer side 132 of the first bra cup 104 may include a substantially convex shape, while the inner side 130 of the first bra cup 104 may include a substantially concave shape. As illustrated, the first neck line 136, the first side edge 138, and the first flange portion 140 together define an outer periphery of the first bra cup 104. The first bra cup 104 is attached to the first side-wing 110 at the first flange portion 140, and the first side-wing 110 extends laterally away from the first flange portion 140. Also, the center gore 108 is attached to the first flange portion 140 and extend outwardly from the first cup portion 134 in a direction opposite to the first side-wing 110.

Similar to the first bra cup 104, the second bra cup 106 also includes an inner side 142, an outer side 144, a second cup portion 146 having a second neck line 148 and a second side edge 150, and a second flange portion 152 extending from the second cup portion 146. The outer side 144 of the second bra cup 106 may include a substantially convex shape, while the inner side 142 of the second bra cup 106 may include a substantially concave shape. The second neck line 148, the second side edge 150, and the second flange portion 152 together define an outer periphery of the second bra cup 106. The second bra cup 106 is attached to the second side-wing 112 at the second flange portion 152, and the second side-wing 112 extends laterally away from the second flange portion 152. Also, the center gore 108 is attached to the second flange portion 152 and extend outwardly from the second cup portion 146 in a direction opposite to the second side-wing 112. Further, the first flange portion 140 includes two sewing thread lines, for example, a first sewing thread line 160 and a second sewing thread line 162, disposed at the outer side 132 of the first bra cup 104, while the inner side 130 of the first bra cup 104 is devoid of any sewing thread lines. Similar to the first bra cup 104, the second bra cup 106 also include two sewing thread lines, for example, a third sewing thread line 164 and a fourth sewing thread line 166, disposed at the outer side 144 of the second bra cup 106, while the inner side 142 of the second bra cup 106 is devoid of any sewing thread lines.

Figure 2:
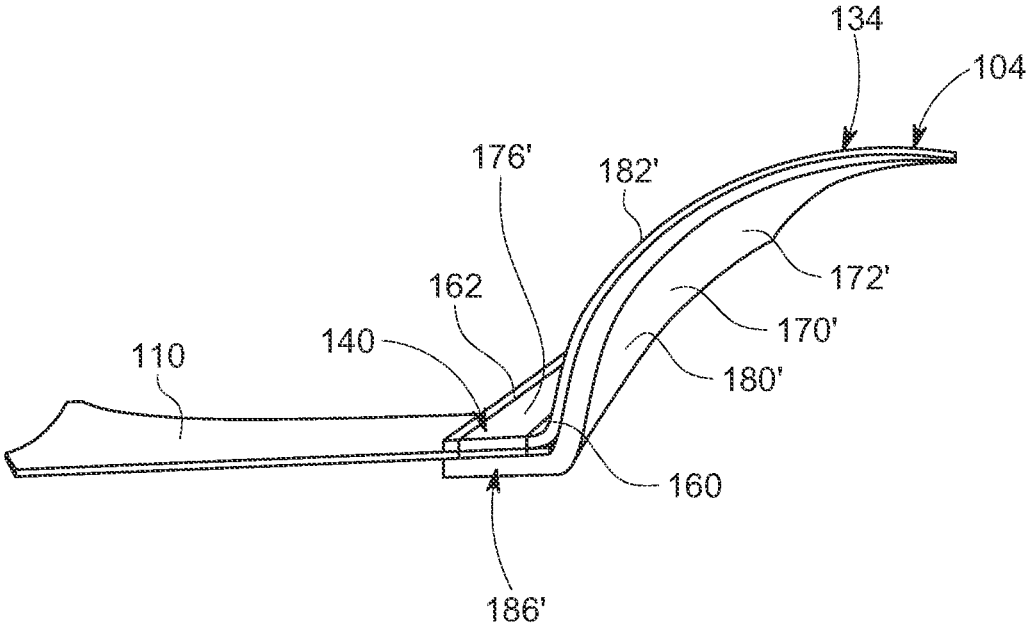
FIG. 2 illustrates a sectional view of the brassiere of FIG. 1A along a line A-A, in accordance with one or more embodiments of the present disclosure.

Referring to FIG. 2, a cross-sectional view of the first bra cup 104 along the sectional line A-A is shown according to one embodiment of the disclosure. As shown, the first cup portion 134 may include a cup 170' of a cup core 172', a portion of an outer layer 176' abutted and attached to an outer side of the cup 170'. In this manner, the cup 170' defines an inner side 180' (or inner layer) of the first cup portion 134, while the outer layer 176' defines an outer side 182' of the first cup portion 134. Further, the first flange portion 140 may include a flange 186' of the cup core 172'. The flange 186' may extend from the cup 170' and is integrally formed with the cup 170'. In an embodiment, the flange 186' may extend an angle to the cup 170'. Further, the first flange portion 140 may include a portion of the outer layer 176' attached/coupled to the flange 186' and is disposed at an outer side of the first flange portion 140. Further, the first flange portion 140 includes a portion of the first side-wing 110 disposed between the flange 186' and the outer layer 176', and is coupled to the flange 186' and the outer layer 176'. In an embodiment, the outer layer 176' and the portion of the first side-wing 110 are attached by using at least one thread line, for example the first thread line 160 and the second thread line 162, disposed at the outer side 132 of the first bra cup 104. It may be appreciated that the thread lines 160, 162 extend, at least partly, along a length of the first flange portion 140. As seen, the thread lines 160, 162 runs through the outer layer 176' and the first side-wing 110, and do not run through the flange 186'. Further, the flange 186' and the first side-wing 110 are attached together without using any threads. In an embodiment, the flange 186' and the first side-wing 110 may be adhesively attached to each other. In this manner, the inner side 130 of the first bra cup 104 is devoid of any thread lines. Additionally, or optionally, the first flange portion 140 may include a plurality of elements and/or layers disposed between the outer layer 176' and the flange 186'.

Figure 3:
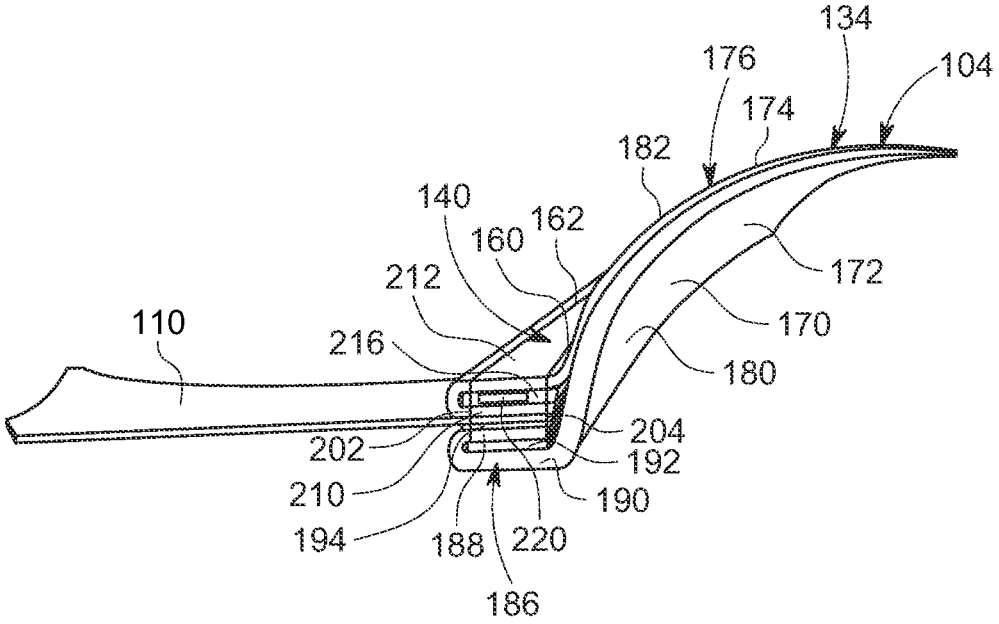
FIG. 3 illustrates a sectional view of the brassiere of FIG. 1A along a line A-A, in accordance with one or more embodiments of the present disclosure.

Referring to FIG. 3, a cross-sectional view of the first bra cup 104 along the sectional line A-A is shown, according to another embodiment of the disclosure. As shown, the first cup portion 134 may include a cup 170 of a molded cup core 172 and a first portion 174 of an outer layer 176 abutted and attached to an outer side of the cup 170. In this manner, the cup 170 defines an inner side 180 of the first cup portion 134, while the first portion 174 of the outer layer 176 defines an outer side 182 of the first cup portion 134. Further, the first flange portion 140 may include a flange 186 of the cup core 172 having a first portion 188 and a second portion 190 extending between the first portion 188 and the cup 170. As shown, the first portion 188 is folded over the second portion 190, and is adhesively attached to the second portion 190. In this manner, an adhesive layer 192 is disposed between the first portion 188 and the second portion 190, and attaches the first portion 188 to the second portion 190. As the second portion 190 of the flange 186 is disposed at the inner side 130 of the first bra cup 104 and the second portion 190 is attached to the first portion 188 by using adhesive, the inner side 130 of the first bra cup 104 is devoid of any thread lines.

Further, the first flange portion 140 may include a stabilizer 194 abutted and attached with the first portion 188, and a portion of the first side-wing 110 is attached to the stabilizer 194 and is disposed above the stabilizer 194. In this manner, the stabilizer 194 may be sandwiched between the first side-wing 110 and the first portion 188. In certain implementations, the stabilizer 194 may be disposed above the first side-wing 110. In such a case, the first side-wing 110 may be sandwiched between the first portion 188 of the flange 186 and the stabilizer 194. In an embodiment, the first portion 188, the portion of the first side-wing 110, and the stabilizer 194 are attached/stitched together using first threads 202, 204. Alternatively, the first side-wing 110 and the stabilizer 194 may be attached adhesively with each other. Further, the flange portion 140 may include a second portion 210 of the outer layer 176 abutting and attached with the first side-wing 110 such that the first side-wing 110 is disposed/sandwiched between the second portion 210 of the outer layer 176 and the stabilizer 194. The stabilizer is generally a piece of non-stretchable or substantially non-stretchable material, which is of a shape generally conforming to the arch shape of the flange or the flange portion. Thus, the stabilizer may include an arch shaped profile that is complimentary to an arch shaped profile of the flange 186. The function of the stabilizer is to 'stabilize' the flange during the manufacturing process, i.e., to maintain the shape and extent of the flange during manufacturing, in particular when the flange is to be subject to various sewing operations which will be described hereinafter. Further, a third portion 212 of the outer layer 176 is folded over the second portion 210. Furthermore, the flange portion 140 may include a wire channel 216 that is sandwiched between the second portion 210 of the outer layer 176 and the third portion 212 of the outer layer 176. It may be appreciated that the first portion 188, the wire channel 216, the stabilizer 194, the second portion 210, the third portion 212, and the first side-wing 110 are attached/stitched together by using at least one thread line, for example, the first thread line 160 and the second thread line 162 such that the thread lines 160, 162 are disposed at the outer side 132 of the first bra cup 140. Further, as illustrated, the thread lines 160, 162 do not run through the second portion 190 of the flange 186. Additionally, or optionally, the first bra cup 104 may include an underwire 220 disposed inside a channel of the wire channel. In an embodiment, the underwire 220 may extend along an entire length of the wire channel 216.

Figure 4:
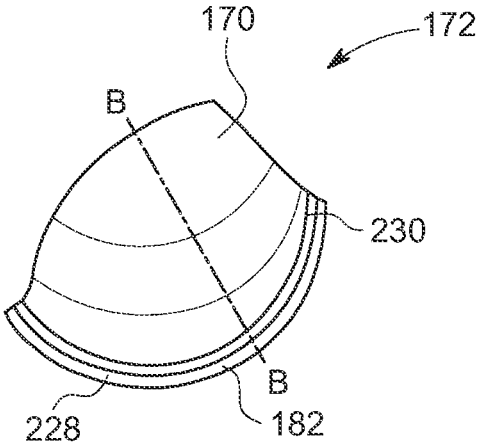
FIG. 4 illustrates a cup core of a first bra cup of the brassiere, the cup core has a cup and a flange, in accordance with one or more embodiments of the present disclosure.
Figure 5:
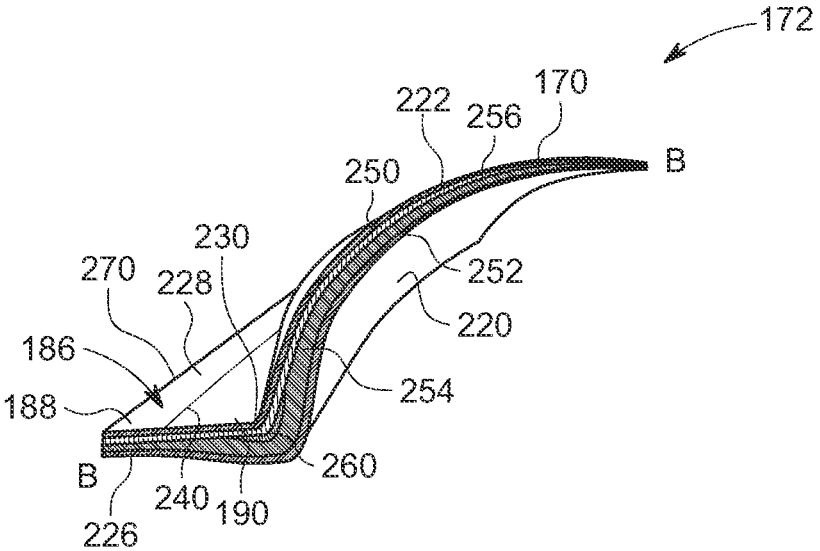
FIG. 5 illustrates a sectional view of the cup core of FIG. 4 along a line B-B, in accordance with one or more embodiments of the present disclosure.

Referring to FIGS. 4 to 15, various steps of a method of manufacturing the brassiere 100 is explained. For sake of clarity and brevity, the various steps of method of manufacturing are explained and discussed with reference to the first bra cup 104 and the first side-wing 110, and it may be appreciated that similar steps will be applicable for the second bra cup 106, the center gore 108, and the second side-wing 112. FIG. 4 discloses a step of the method in which the molded cup core 172 is provided. As shown in FIGS. 4 and 5, the cup core 172 may include the cup 170 having an inner side 221 and an outer side 222, and the flange 186 having an inner surface 226 and an outer surface 228. The flange 186 may extend substantially horizontally from the cup 170 and defines a flange boundary 230 at an interface of the cup 170 and the flange 186. Further, the flange 186 may include the first portion 188 and the second portion 190 extending from the first portion 188 to the flange boundary 230. In an implementation, the first portion 188 and the second portion 190 are separated by a virtual boundary line 240 (hereinafter referred to as fold line 240). Also, as shown, the molded cup core 172 may be made of a plurality of layers and may include an outer fabric layer 250, an inner fabric layer 252, and an inner foam layer 254 disposed between the outer fabric layer 250 and the inner fabric layer 252 and abutted with the inner fabric layer 252. The cup core 172 may also include an outer foam layer 256 sandwiched between the inner foam layer 254 and the outer fabric layer 250, and abutting both the outer fabric layer 250 and the inner foam layer 254. As shown, the outer fabric layer 250, the inner fabric layer 252, the inner foam layer 254, and the outer foam layer 256 extend along an entire cup 170 and the flange 186 of the cup core 172. The outer fabric layer, the outer foam layer, the inner foam layer, and the inner fabric layer are laminated together. Further, a foam pad 260 may also be disposed inside the cup core 172 at an interface of the flange 186 and cup 170 such that the foam pad 260 is disposed/sandwiched between the outer foam layer 256 and the inner foam layer 254.

Figure 6:
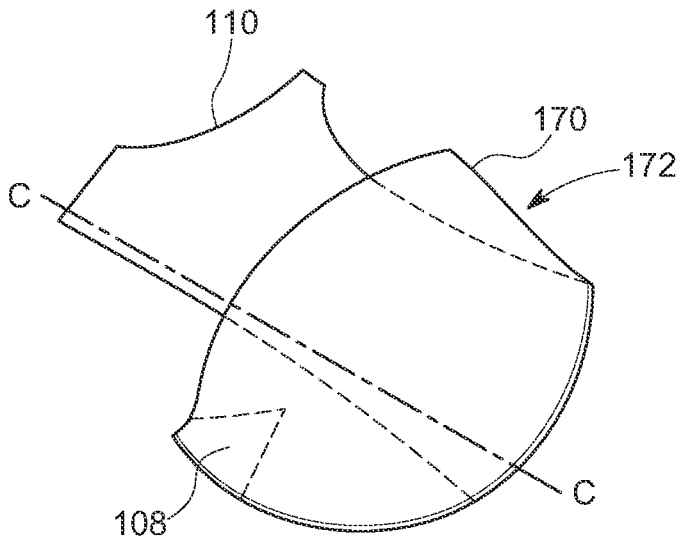
FIG. 6 illustrates a step of the method of manufacturing the brassiere in which a stabilizer, a first side-wing, and the flange are attached, in accordance with one or more embodiments of the present disclosure.
Figure 7:
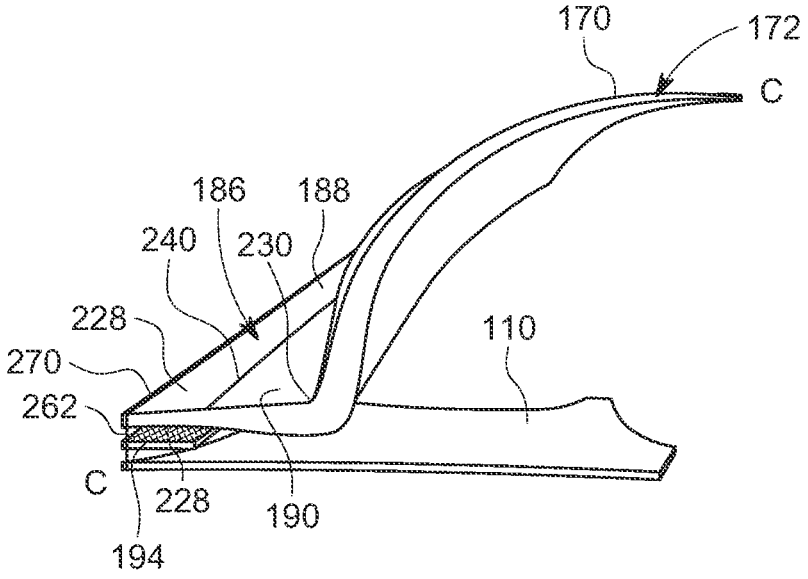
FIG. 7 illustrates a sectional view of FIG. 6 along a line C-C, in accordance with one or more embodiments of the present disclosure.

Thereafter, as shown in FIGS. 6 & 7, the stabilizer 194 and the first side-wing 110 are attached to the flange 186 of the cup core 172. For so doing, the stabilizer 194 is positioned abutting the inner surface 226 of the flange 186, and the first side-wing 110 is positioned abutting the stabilizer 194. Therefore, the flange 186, the stabilizer 194, and first side-wing 110 are arranged such that stabilizer 194 is sandwiched between the first portion 188 of the flange 186 and a portion of the first side-wing 110. In certain embodiments, the first side-wing 110 may be sandwiched between the first portion 188 and the stabilizer 194. Further, in so doing, the first side-wing 110 and the cup 170 of the cup core 172 are disposed in substantially same direction (best shown in FIG. 6). After arranging the stabilizer 194, the first portion 188 of the flange 186, and the first side-wing 110 together, the stabilizer 194, the first portion 188 of the flange 186, and the first side-wing 110 may be stitched together using first thread 262. In some implementations, the first portion 188, the stabilizer 194, and the first side-wing 110 may be adhesively attached to each other. As illustrated, the stabilizer 194 is attached to the first portion 210 of the flange 186 such that stabilizer 194 abuts the inner surface 226 of the flange 186 and extends from a free edge 270 of the flange 186 to the fold line 240.

Figure 8:
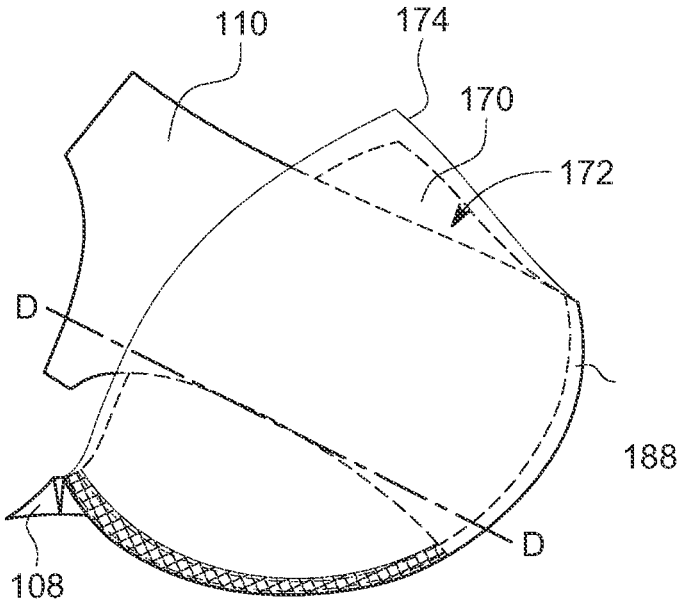
FIG. 8 illustrates a step of the method of manufacturing the brassiere in which an outer layer is attached to the side-wing and the flange, in accordance with one or more embodiments of the present disclosure.
Figure 9:
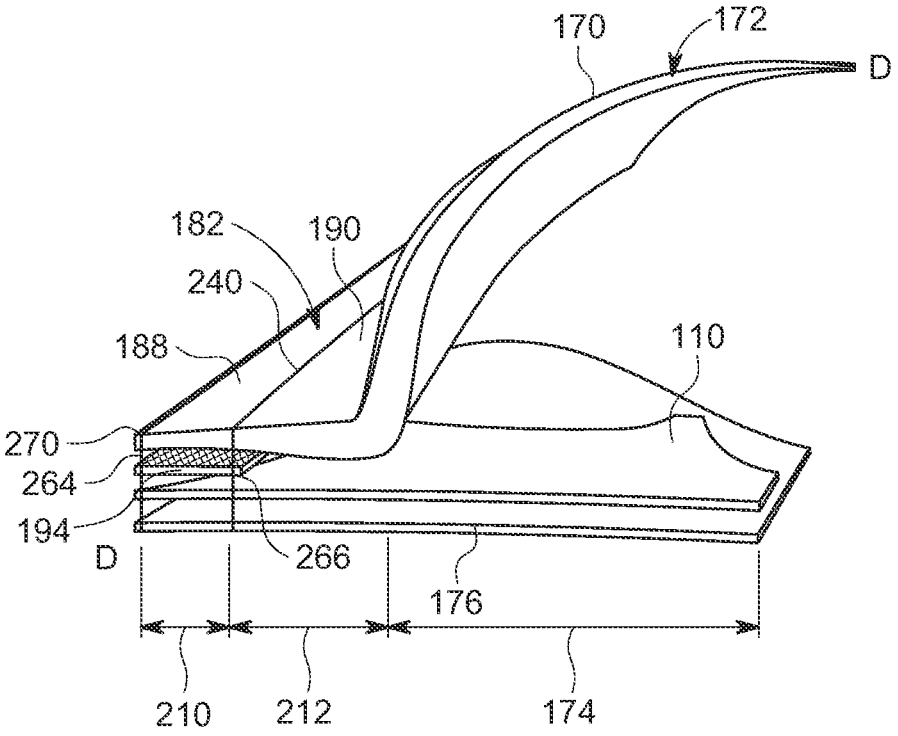
FIG. 9 illustrates a sectional view of FIG. 8 along a line D-D, in accordance with one or more embodiments of the present disclosure.

Upon attaching the first side-wing 110 and the stabilizer 194 to the flange 186, the outer layer 176 is attached/coupled to the flange 186 (as shown in FIGS. 8 and 9). For so doing, the second portion 210 of the outer layer 176 is positioned below the first side-wing 110. In an embodiment, outer layer 176 may be arranged in such a manner that the second portion 210 abuts the first side-wing 110. In this manner, the first side-wing 110 may be sandwiched between the second portion 210 of the outer layer 176 and the stabilizer 194. As shown, the outer layer 176 is arranged in such a manner that the outer layer 176 and the first side-wing 110 extend in the same direction from the flange 186. Thereafter, the second portion 210 of the outer layer 176, the first side-wing 110, the stabilizer 194, and the first portion 188 of the flange 186 are stitched together by using second threads 264, 266. In an embodiment, the second threads 266, 268 overlap the first threads 262, 264. Alternatively, the second portion 210 of the outer layer 176 may attached to the stabilizer 194 and/or the first side-wing 110 by using adhesive. Further, it may be envisioned that the outer layer 176 may include relatively larger dimensions as compared to the cup 170 such that outer layer 176 extends beyond the edges of the cup 170.

Figure 10:
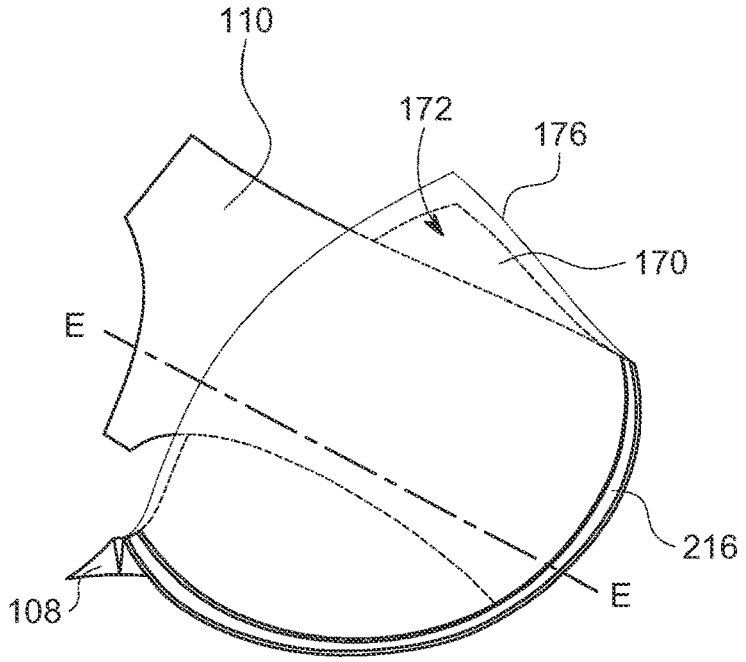
FIG. 10 illustrates a step of the method of manufacturing the brassiere in which a wire channel is attached to the outer layer and the flange, in accordance with one or more embodiments of the present disclosure.
Figure 11:
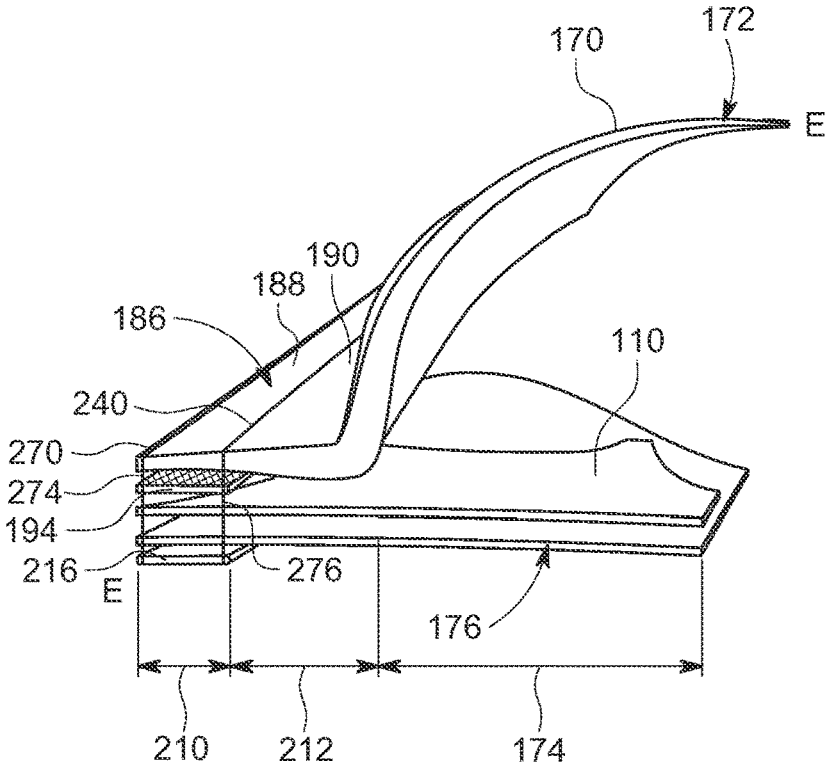
FIG. 11 illustrates a sectional view of FIG. 10 along a line E-E, in accordance with one or more embodiments of the present disclosure.

Thereafter, as shown in FIGS. 10 and 11, the method may include attaching the wire channel 216 to the outer layer 176 and the flange 186. For so doing, as shown in FIG. 10, the wire channel is positioned abutting the second portion 210 of the outer layer 176 such that the second portion 210 of the outer layer 176 is sandwiched between the first side-wing 110 and the wire channel 216. In an embodiment, the wire channel 216 may include an arch shaped profile that is complementary to an arch shape profile of the flange 186 or the second portion 210 of the outer layer 176. As illustrated, a width of the wire channel 216 is smaller than a width of the flange 186, and may be substantially equal to a width of the first portion 188 of the flange 186 and/or a width of the second portion 210 of the outer layer 176. After arranging the wire channel 216 relative to the outer layer 176, the wire channel 216 is attached to the flange 186. In an embodiment, the wire channel 216 is attached to the flange 186 by sewing the first portion 188 of the flange 186, the stabilizer 194, the first side-wing 110, and the second portion 210 of the outer layer 176 together by using third threads 274, 276 (best shown in FIG. 11). In an embodiment, the third threads 274, 276 overlap the first thread 262 and the second threads 264, 266. In certain implementations, the wire-channel 216 may be adhesively attached to the second portion 210 of the outer layer 176.

Figure 12:
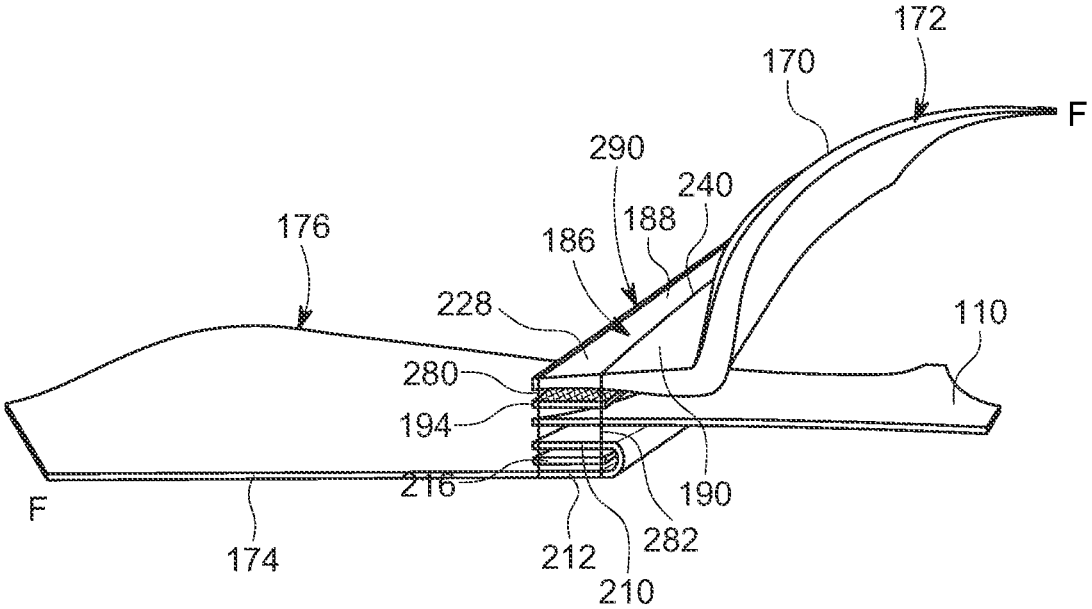
FIG. 12 illustrates a step of the method of manufacturing of the brassiere in which an outer layer is folded to enwrap the wire channel, in accordance with one or more embodiments of the present disclosure.

Subsequently, as shown in FIG. 12, the method includes folding the outer layer 176 to enwrap the wire channel 216. For so doing, the outer layer 176 is folded such that the wire channel 216 is sandwiched between the second portion 210 of the outer layer 176 and the third portion 212 of the outer layer 176. In this manner, after folding of the outer layer 176, the first portion 174 of the outer layer 176 may extend in direction opposite to the direction of extension of the first side-wing 110 and the cup 170 from the flange 186. Upon folding the outer layer 176 around the wire channel 216, the first portion 188 of the flange 186, the stabilizer 194, the first side-wing 110, the second portion 210 of the outer layer 176, the wire channel 216, and the third portion 212 of the outer layer 176 may be stitched together by using fourth threads 280, 282. In this manner a flange panel 290 is formed. The flange panel 290 may include the first portion 188 of the flange 186, the stabilizer 194, the first side-wing 110, the second portion 210 of the outer layer 176, the wire channel 216, and the third portion 212 of the outer layer 176.

Figure 13:
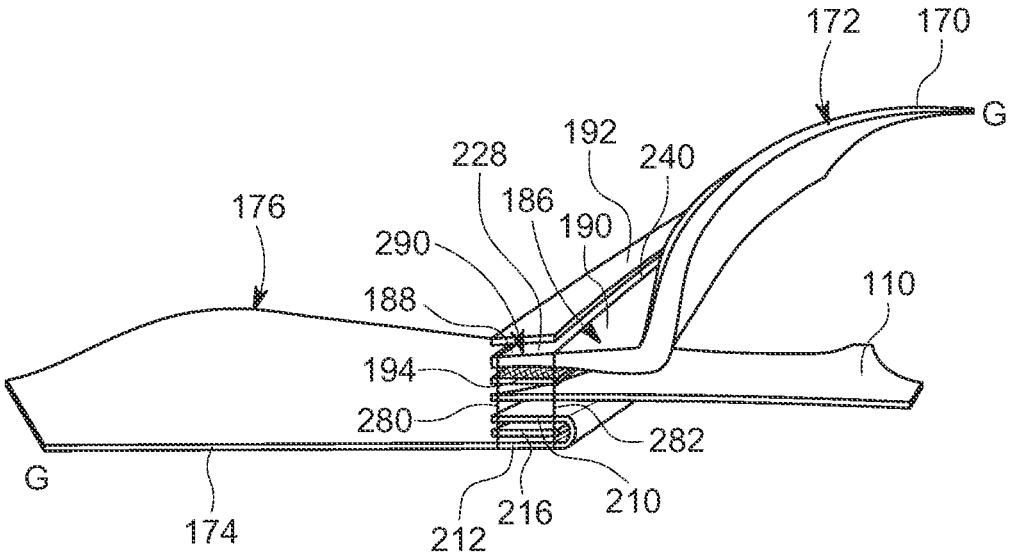
FIG. 13 illustrates a step of the method of manufacturing of the brassiere in which an adhesive is applied on a first portion of the flange, in accordance with one or more embodiments of the present disclosure.
Figure 14:
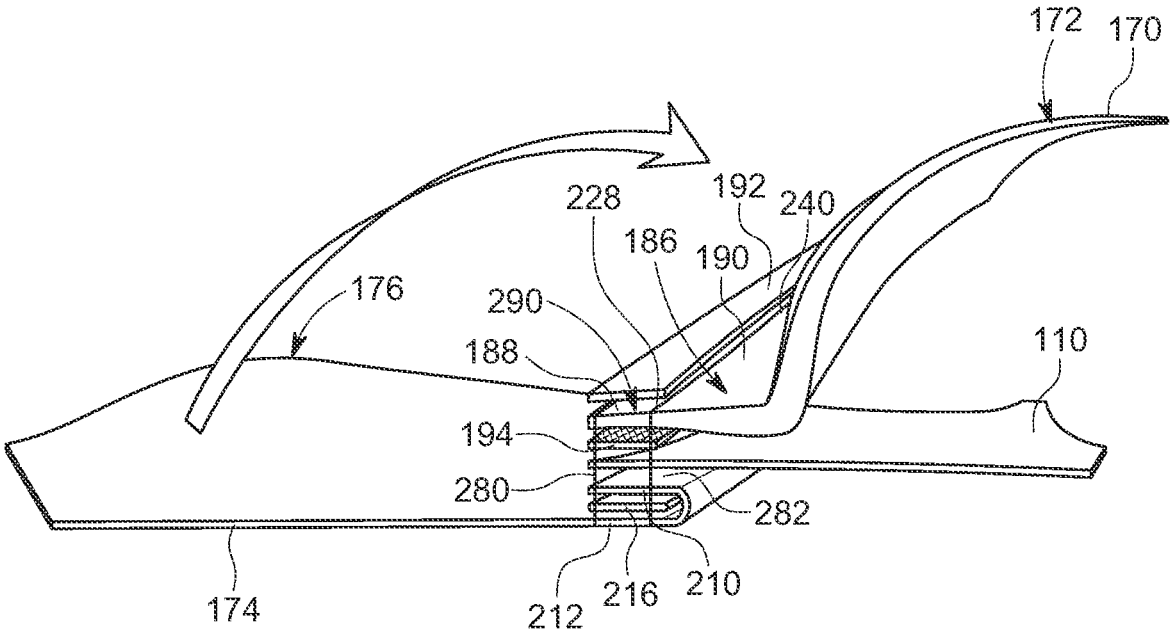
FIG. 14 illustrates a step of the method of manufacturing of the brassiere in which the flange and the outer layer is folded along a fold line to adhesively attach the first portion of the flange to the second portion of the flange, in accordance with one or more embodiments of the present disclosure.
Figure 15:
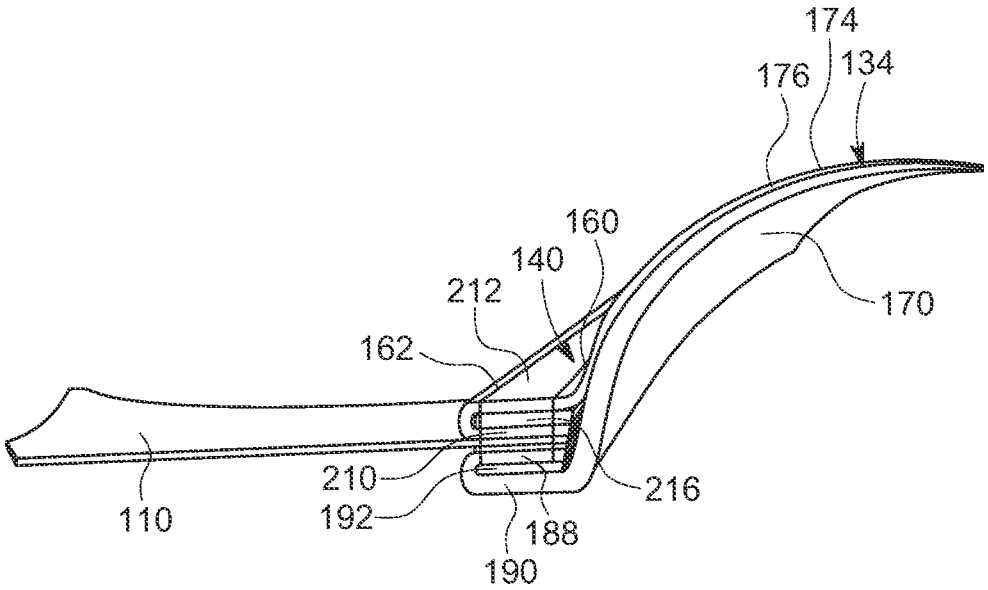
FIG. 15 illustrates a step of the method of manufacturing of the brassiere in which first side-wing is flipped, in accordance with one or more embodiments of the present disclosure.

Thereafter, as shown in FIG. 13 and FIG. 14, the method includes adhesively attaching the first portion 188 of the flange 186 to the second portion 190 of the flange 186, and attaching the first portion 174 of the outer layer 176 with the cup 170 of the cup core 172. For so doing, as shown in FIG. 13 an adhesive is applied on the first portion 188 of the flange 186. As shown, the adhesive is applied in the form of the adhesive layer or film 192 on the outer surface 228 of the first portion 188 of the flange 186. The adhesive layer 192 may include an arch shaped profile that is complimentary to an arch shaped profile of the flange 186. Thereafter, as indicated in FIG. 14, the first portion 174 of the outer layer 176 along with the flange panel 290 are folded along the fold line 240, and the first portion 188 of the flange 186 is adhesively bonded with the second portion 190 of the flange 186. Also, the first portion 174 of the outer layer 176 covers the cup 170. Thereafter, for adhesively securing the first portion 188 of the flange 186 and the second portion 190 of the flange 186, pressing and curing may be performed. Upon covering the cup 170 with the first portion 174 of the outer layer 176, the edges of the outer layer 176 may be trimmed and folded to enwrap the cup 170 and adhesively attached to an inner side of the cup 170. Thereafter, the first side-wing 110 is flipped 180 degrees (as shown in FIG. 15) such that the cup 170 and the first side-wing 110 extend in opposite directions from the flange portion 140. Additionally, or optionally, as shown in FIG. 3, the underwire 220 is inserted into the wire channel 216 to provide additional rigidity to the first flange portion 140. In this manner, the first bra cup 104 is attached with the first side-wing 110 and the first flange portion 140 of the first bra cup 104 is formed. As the second portion 190 of the flange 186 is disposed on the inner side 130 of the first bra cup 104, the inner side 130 of the first bra cup 104 is devoid any sewing thread lines, providing extra comfort and aesthetic effect to a wearer of the brassiere 100.

Further, the center gore 108 is also attached to the first bra cup in a manner similar to the attachment of the first bra cup 104 with the first side-wing 110 as explained above. In an embodiment, the center gore 108 may be attached to the first bra cup 104 simultaneously during the attachment of the first bra cup 104 with the first side-wing 110. Further, it may be appreciated that the second side-wing 112, the second bra cup 106, and the center gore 108 may be attached in a similar manner as described above. In this manner, the brassiere 100 is formed.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

What is claimed is:

1. A method of manufacturing a bra cup of a brassiere, the method comprising:

providing a cup core having a cup and a flange extending along a periphery of the cup, the flange including a first portion and a second portion separated by a fold line;

attaching a portion of a side-wing to the first portion of the flange;

attaching an outer layer to the first portion of the flange and the side-wing such that the side-wing is disposed between the flange and the outer layer;

attaching a wire channel to the outer layer and the flange and folding the outer layer to enwrap the wire channel;

folding the outer layer and the first portion of the flange along the fold line to attach the first portion of the flange to the second portion of the flange; and attaching a first portion of the outer layer to the cup, wherein the portion of the side-wing is attached to the outer layer by using at least one thread line, wherein the at least one thread line is disposed on an outer side of the bra cup, and the inner side of the bra cup is devoid of thread line.

2. The method of claim 1, wherein the portion of the side-wing is attached to the first portion of the flange by using first thread.

3. The method of claim 1 further including positioning a stabilizer between the first portion of flange and the side-wing, wherein the stabilizer is positioned abutting an inner surface of the flange.

4. The method of claim 1, wherein the outer layer includes a second portion and a third portion extending between the second portion of the outer layer and the first portion of the outer layer, wherein the second portion of the outer layer is attached to the side-wing using second threads.

5. The method of claim 4, wherein, the outer layer enwraps the wire channel such that the wire channel is sandwiched between the second portion of the outer layer and the third portion of the outer layer.

6. The method of claim 4, wherein the wire channel is attached to the outer layer and the flange by stitching the first portion of the flange, the side-wing, the second portion of the outer layer, and the wire channel by using third threads.

7. The method of claim 4, wherein the third portion of the outer layer, the second portion of the outer layer, the wire channel, the side-wing, and the first portion of the flange are stitched together using fourth threads.

8. The method of claim 1 further including inserting an underwire inside the wire channel.

9. The method of claim 1, wherein the cup core includes:

an outer fabric layer and an inner fabric layer;

an inner foam layer disposed between the outer fabric layer and the inner fabric layer, wherein the inner foam layer abuts the inner fabric layer; and an outer foam layer sandwiched between the outer fabric layer and the inner foam layer, wherein the outer foam layer abuts the outer fabric layer and the inner foam layer.

10. A brassiere, comprising:

a side-wing;

a bra cup having a cup portion and a flange portion attached to the side-wing, the flange portion including:

a flange of a cup core, the flange having a first portion and a second portion adhesively attached to the first portion, wherein the second portion is disposed at an inner side of the bra cup;

a portion of the side-wing attached with the first portion of the flange; and an outer layer having a second portion and a third portion folded over the second portion, and enwrapping a wire channel therebetween, the third portion of the outer layer being disposed at an outer side of the bra cup, wherein the second portion of the outer layer, the third portion of the outer layer, the wire channel, the first portion of the flange and the side-wing are attached together by using at least one thread line, wherein the at least one thread line is disposed on an outer side of the bra cup and the inner side of the bra cup is devoid of thread line.

11. The brassiere of claim 10 further including a stabilizer sandwiched between the first portion of the flange and the side-wing.

12. The brassiere of claim 10 further including an underwire disposed inside the wire channel.

13. The brassiere of claim 10, wherein the second portion of the outer layer is sandwiched between the wire channel and the side-wing.

14. The brassiere of claim 10, wherein the cup portion of the bra cup includes a cup of the cup core and a first portion of the outer layer attached to the cup.

15. The brassiere of claim 10 wherein the cup core includes:

an outer fabric layer and an inner fabric layer;

an inner foam layer disposed between the outer fabric layer and the inner fabric layer, wherein the inner foam layer abuts the inner fabric layer; and an outer foam layer sandwiched between the outer fabric layer and the inner foam layer, wherein the outer foam layer abuts the outer fabric layer and the inner foam layer.

16. The brassiere of claim 15, wherein the cup core further includes a foam pad sandwiched between the outer foam layer and the inner foam layer and located at an interface of the flange and the cup.

* * * * *